US011572782B2

(12) United States Patent
McLeod et al.

(10) Patent No.: US 11,572,782 B2
(45) Date of Patent: Feb. 7, 2023

(54) METHOD AND SYSTEM FOR ENABLING AT SURFACE CORE ORIENTATION DATA TRANSFER

(71) Applicant: Reflex Instruments Asia Pacific Pty Ltd, Balcatta (AU)

(72) Inventors: Gavin McLeod, Attadale (AU); Kelvin Brown, Sorrento (AU)

(73) Assignee: RELEX INSTRUMENTS ASIA PACIFIC PTY LTD, Balcatta (AU)

( * ) Notice: Subject to any disclaimer, the term of this patent is extended or adjusted under 35 U.S.C. 154(b) by 131 days.

(21) Appl. No.: 17/006,400

(22) Filed: Aug. 28, 2020

(65) Prior Publication Data

US 2020/0392835 A1 Dec. 17, 2020

Related U.S. Application Data

(63) Continuation of application No. 16/075,299, filed as application No. PCT/AU2017/050093 on Feb. 3, 2017, now abandoned.

(30) Foreign Application Priority Data

Feb. 4, 2016 (AU) ..... 2016900369

(51) Int. Cl.

| | |
|---|---|
| ***E21B 47/09*** | (2012.01) |
| ***E21B 47/26*** | (2012.01) |
| ***E21B 25/16*** | (2006.01) |
| ***E21B 25/00*** | (2006.01) |
| ***E21B 47/024*** | (2006.01) |

(52) U.S. Cl.
CPC ..... *E21B 47/09* (2013.01); *E21B 25/005* (2013.01); *E21B 25/16* (2013.01); *E21B 47/024* (2013.01); *E21B 47/26* (2020.05)

(58) Field of Classification Search
CPC ..... E21B 47/09; E21B 25/16; E21B 25/005; E21B 47/26
See application file for complete search history.

(56) References Cited

U.S. PATENT DOCUMENTS

| | | | | |
|---|---|---|---|---|
| 3,115,196 A * | 12/1963 | Roxstrom | ..... | E21B 25/16 175/44 |
| 7,296,638 B2 * | 11/2007 | Beach | ..... | E21B 25/16 175/244 |
| 8,387,721 B2 * | 3/2013 | Beach | ..... | E21B 25/16 175/245 |

* cited by examiner

*Primary Examiner* — Catherine Loikith
(74) *Attorney, Agent, or Firm* — Felix L. Fischer

(57) ABSTRACT

A contactless orientation system coupled with an inner core tube to one or more record carriers on or associated with a core sample held in the core tube having a longitudinal core axis and a core face accessible from an end of the inner core tube. An instrument guide is coupled to the end of the core tube from which the core face is accessible with an axis of the guide parallel to the core axis. Correlation information is generated between a rotational orientation of a known point P on the instrument guide about the guide axis and core orientation data known to the contactless orientation system. The instrument acts as the record carrier or generates the record carrier provided with the correlation information enabling orientation of the core sample to its in-situ orientation when released from the core tube.

20 Claims, 6 Drawing Sheets

METHOD AND SYSTEM FOR ENABLING AT SURFACE CORE ORIENTATION DATA TRANSFER

REFERENCES TO RELATED APPLICATIONS

This application is a continuation of application Ser. No. 16/075,299 filed on Aug. 3, 2018 which is a national stage filing under 35 U.S.C. 371 and claims priority of International Application serial no. PCT/AU2017/050093 having an international filing date of Feb. 3, 2017 which in turn claims priority of Australian patent application serial no. 2016900369 filed on Feb. 4, 2016, the disclosures of which are incorporated herein by reference.

BACKGROUND

Technical Field

A method and system are disclosed for enabling at surface core orientation data transfer from a contactless orientation system.

Background Art

Core sampling is employed to allow geological surveying of the ground for the purposes of exploration and/or mining development. Analysis of the composition of the core sample provides information of the geological structures and composition of the surrounding ground. In order to maximise the usefulness of this information it is necessary to have knowledge of the orientation of the core sample relative to the ground from which it is extracted.

Many types of core orientation systems are available for determining the in-situ orientation of the core. Back end core orientation systems, also known as contactless core orientation systems, usually rely on gyroscopic, magnetic or gravitational sensors and devices for determining core orientation. These systems do not leave a physical mark of orientation on the core sample at the time of recording the core orientation or otherwise provide a permanent record of the core orientation that is carried by or associated with the sample. Such a physical mark or record is required by a geologist to enable them to determine the orientation of the core sample. The process of making such a core orientation record is performed at the surface, usually by the use of marking guides and jigs which support an inner core tube together with its corresponding backend or contactless orientation system. The jig allows the operator to rotate the core sample about the core axis so that at a pre-determined point (for example, bottom dead centre) is orientated to a known position (typically either the 180° position or the 0° position). The operator then physically marks the core sample on the core face, or the outer circumferential surface or both with a pencil or scribe denoting the location at that point. Thus when a geologist views the core sample they are able to easily discern the in-situ rotational position of the core sample.

While a marking guide usually used to assist in accurately placing the physical mark on the core sample, it has been found that there can be a high degree of inaccuracy in the data transfer. This is due primarily to: difficulty in using the marking guide because of the irregular and random geometry of the core face; operator carelessness; or human error. If the only mark made on the core sample is a dot on the core face there is also a risk of the underlying section of the core face being broken off when the core sample is released from the core tube and associate core lifter assembly. A further deficiency is that once the mark has been made and the core orientation system used for the next core run, the ability to audit the marking for accuracy is lost.

There is a need for a method and system for increasing accuracy and reliability of core orientation data transfer from a backend and/or other contactless core orientation system to a record carrier associated with the core sample.

SUMMARY OF THE DISCLOSURE

In one aspect there is disclosed a method of enabling at surface orientation data transfer from a contactless orientation system coupled with an inner core tube to one or more record carriers on or associated with a core sample held in the core tube, the core sample having a longitudinal core axis and a core face accessible from an end of the inner core tube, the method comprising:

- coupling an instrument guide having a guide axis to the end of the core tube from which the core face is accessible wherein the guide axis is parallel to the core axis;
- generating correlation information between a rotational orientation of a known point on the instrument guide or an instrument supported by the instrument guide about the guide axis with core orientation data known to the contactless orientation system; and
- using the instrument to: act as the record carrier; or generate the record carrier provided with the correlation information enabling orientation of the core sample to its in-situ orientation when released from the core tube.

In one embodiment generating correlation information comprises referencing the rotational position of the known point and the in-situ rotational orientation known to the contactless orientation system to a common reference point.

In one embodiment generating correlation information comprises operating the contactless orientation system to facilitate positioning of the core sample about the core axis so that the in situ orientation coincides with the orientation of the common reference point.

In one embodiment generating correlation information comprises rotationally aligning the known point with the common reference point.

In one embodiment operating the instrument comprises using the instrument guide to move the instrument in a direction parallel to the core axis to contact the core face wherein on contact with the core face the instrument constitutes, or is capable of producing, a record carrier provided with the transferred orientation data.

In one embodiment generating the correlation information comprises electronically determining the rotational position of the known point.

In one embodiment generating the correlation information comprises electronically transferring the orientation data from the core orientation system to the instrument.

In a second aspect there is disclosed a method of enabling at surface orientation data transfer from a contactless orientation system coupled with an inner core tube to one or more record carriers on or associated with a core sample held in the core tube, the core sample having a longitudinal core axis and a core face accessible from an end of the inner core tube, the method comprising:

- arranging an instrument guide which has opposite first and second ends relative to the core sample so that the core face lies between the first and second ends of the instrument guide, and a guide axis, that runs through the first and second ends, lies parallel to the core axis; and using the instrument guide to move an instrument in a direction parallel to the core axis to contact the core face wherein on contact with the core face the instrument constitutes, or is capable of producing, a record carrier of the orientation of the core sample.

In one embodiment the method comprises prior to moving, generating correlation information between a known point on the instrument guide about the guide axis and core orientation data known to the contactless core orientation system.

In one embodiment the method comprises operating the instrument supported in or by the instrument guide to: act as the record carrier; or generate the record carrier provided with, or otherwise having transferred to it, the correlation information enabling orientation of the core sample to its in-situ orientation when released from the core tube.

In one embodiment the method comprises generating correlation data comprises rotationally aligning the known point with the core orientation a common reference point about the core axis.

In one embodiment using the instrument guide comprises engaging the instrument with the instrument guide and moving the instrument relative to the core face and parallel to the core axis to cause contact between the core face and the instrument.

In one embodiment of the first and second aspects moving the instrument parallel to the core axis relative to the core face comprises either (a) moving the instrument along, through or within the instrument guide relative to the core face to cause contact between the core face and the instrument; or (b) moving the instrument guide relative to the core face to cause contact between the core face and the instrument.

In one embodiment of the first and second aspects the method comprises demountably engaging the instrument with the instrument guide wherein after contact with the core face the instruments can be removed from the instrument guide.

In one embodiment the method comprises removing the instrument from the instrument guide after contact with the core face.

In one embodiment of the first and second aspects the method comprises recording on or in the instrument, header data relating to the core sample.

In one embodiment the method comprises manually recording the header data on the instrument.

In one embodiment the method comprises wireless transferring header data for recording in the instrument or on the record carrier.

In one embodiment of the first and second aspects the method comprises electronically recording in or on the record carrier audit data relating to the core sample.

In one embodiment the method comprises electronically recording in or on the record carrier, header data and audit data relating to the core sample.

In one embodiment recording audit data comprise recording one more of: (a) the time of day when the instrument was moved in a direction parallel to the core axis to contact the core face; (b) the date of moving the instrument in a direction parallel to the core axis to contact the core face; (c) the geographic location of the core sample in relation to which the method is performed; (d) a degree and direction of rotation of the instrument guide relative to the core tube about the core axis during the referencing of the rotational positions of the points and moving of the parallel to the core axis to cause contact between the core face and the instrument; (e) tool face of the core sample.

In one embodiment of the first and second aspects the method comprises arranging the instrument to record data pertaining to the profile of the core face.

In one embodiment of the first and second aspects the record carrier comprises an electronic image captured by the instrument of the core face and wherein the known point is visually represented on the image.

In one embodiment the record carrier further comprises electronic data pertaining to the rotational orientation of the known point.

In one embodiment the instrument comprises a plastically deformable pad or a plurality of linearly translatable pins which on contact with the core face are capable of recording data pertaining to the profile of the core face.

In one embodiment of either aspect the method comprises providing the instrument with an electronic memory device capable of storing or processing data communicated by the contactless orientation system.

In a third aspect there is disclosed a system for enabling at surface orientation data transfer from a contactless orientation system coupled with an inner core tube to one or more record carriers associated with a core sample held in the core tube, the core sample having a longitudinal core axis and a core face visible from an end of the inner core tube, the system comprising:

an instrument guide having opposite first and second ends that lie on a common guide axis, the instrument guide configured so that when the first end is engaged with the core tube the core face lies between the first and second ends of the instrument guide; and an instrument demountable coupled with the instrument guide in a manner wherein the instrument guide facilitates motion of the instrument in a direction parallel to the core axis to a location where the instrument contact the core face.

In one embodiment the instrument and the instrument guide are provided with respective coupling parts that enable demountable coupling of the instrument to the instrument guide in known rotational juxtaposition about the guide axis.

In one embodiment the instrument comprises one or both of: (a) a core face profile recording system; and (b) a scribe or marker capable of placing a mark on the core face.

In one embodiment the core face profile recording system comprises either (a) a plurality of axially displaceable pins or (b) a pad of plasticised material capable of taking an imprint of the core face.

In one embodiment the instrument comprises a surface on which header data can be manually transcribed.

In one embodiment the method comprises a rotation sensing device capable of detecting rotation of the instrument guide about the guide axis.

In one embodiment the instrument comprises an electronic memory device capable of recording one or both of (a) header data, and (b) audit data relating to the core sample.

In a fourth aspect there is provided a method of at surface wireless core orientation data transfer from a contactless orientation system coupled with an inner core tube to an electronically recordable file associated with a core sample held in the core tube, the core sample having a longitudinal core axis and a core face visible from an end of the inner core tube, the method comprising:

positioning an image plane of an image capture device to lie substantially perpendicular to the core axis and at a location to enable the image capture device to capture an image of the core face;

generating correlation information between a rotational position about the core axis of a known point on the image plane with a rotational point in space about the core axis known to the contactless orientation system and being representative of an in situ rotational orientation of the core sample; and producing an electronically recordable file comprising at least the captured image and the rotational position reference data associated with the core sample.

In one embodiment generating the rotational position reference data comprises wirelessly communicating the rotational position of the point on the core sample about the core axis having a position known to the contactless orientation system rotational position.

BRIEF DESCRIPTION OF DRAWINGS

Notwithstanding any other forms which may fall within the scope of the method and system as sets forth in the Summary, specific embodiments will now be described, by way of example only, with reference to the accompanying drawings in which.

DETAILED DESCRIPTION

Figure 1:
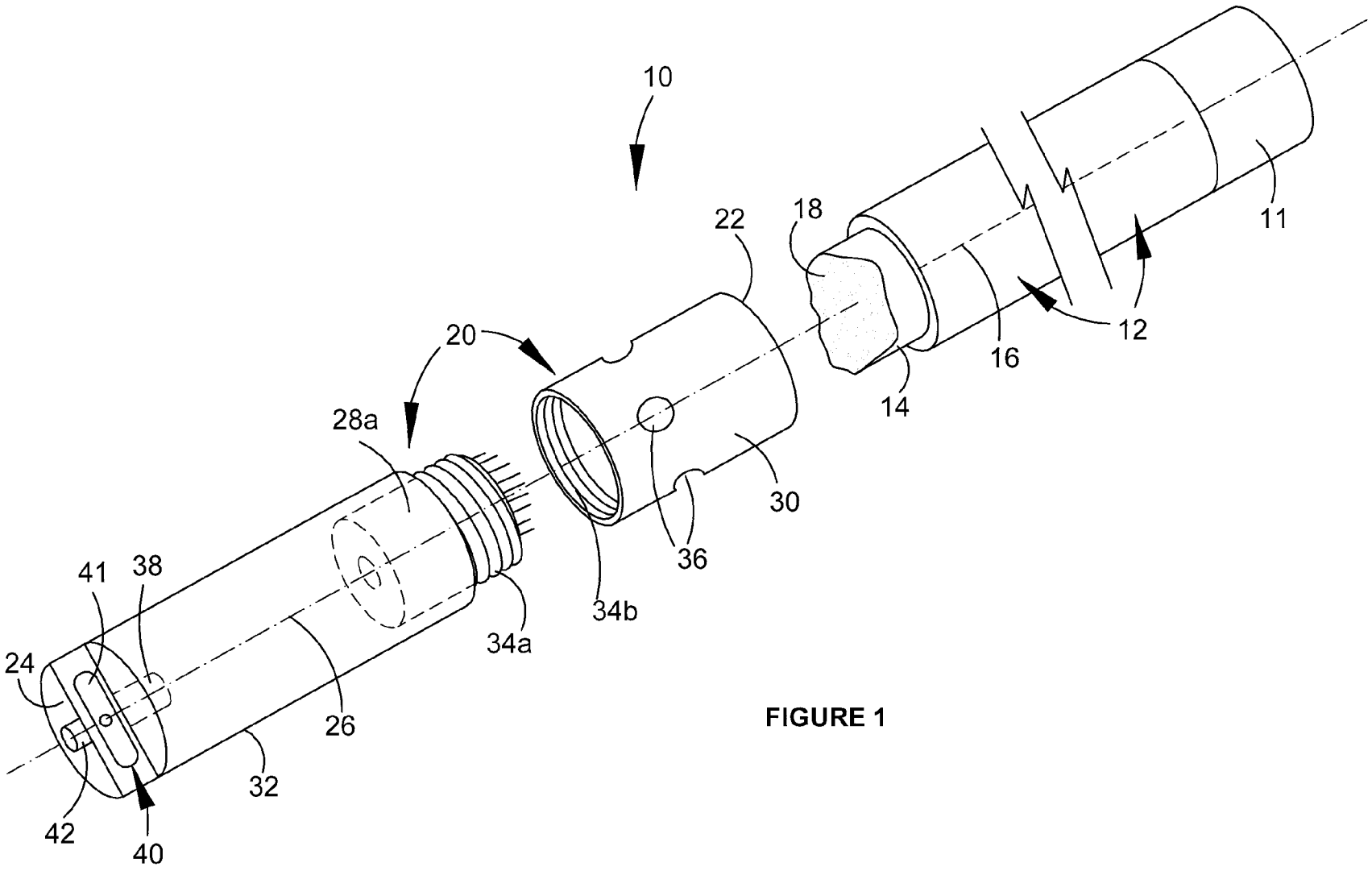
FIG. 1 is a schematic representation of a system for enabling at surface core orientation data transfer from a contactless orientation system to one or more record carriers.
Figure 2:
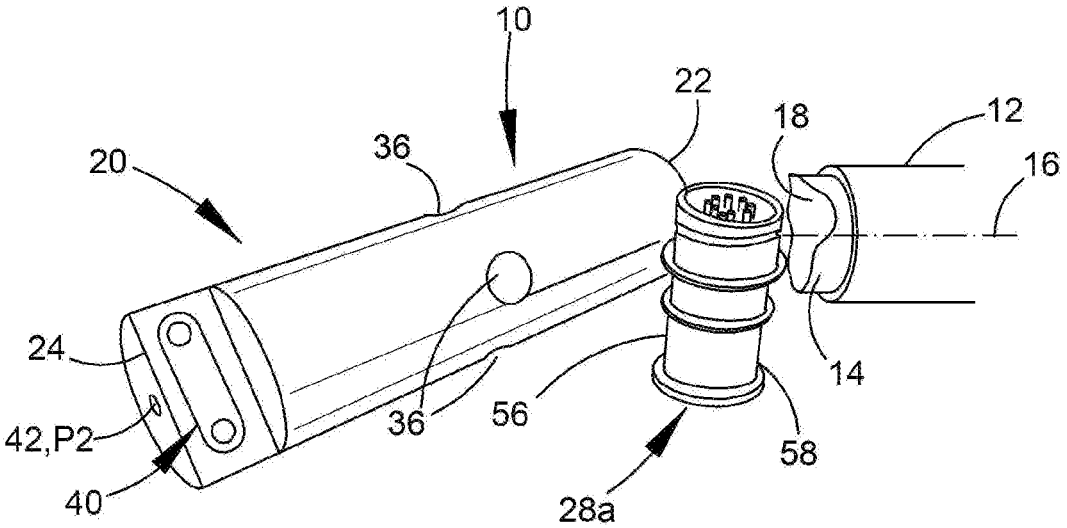
FIG. 2 is a further representation of the embodiment of the system shown in FIG. 1 disposed near a core sample held within a core tube and showing an instrument guide of the system in an assembled condition but with an associated instrument and record carrier separate from the instrument guide.

FIGS. 1 and 2 depict an embodiment of a system 10 for enabling at surface core orientation data transfer from a contactless core orientation system 11 coupled with a core tube 12. A core sample 14 is captured in the core tube 12. The core sample 14 has a longitudinal core axis 16 and an exposed core face 18. The core orientation system may be coupled to or otherwise housed in an up-hole end of a core tube 12. The specific nature of the core orientation system 11 is not material to the disclosed system and method. However one commercially available example of a contactless core orientation system is the REFLEX ACT III orientation system (see for example http://reflexnow.com/act-III/).

Figure 4:
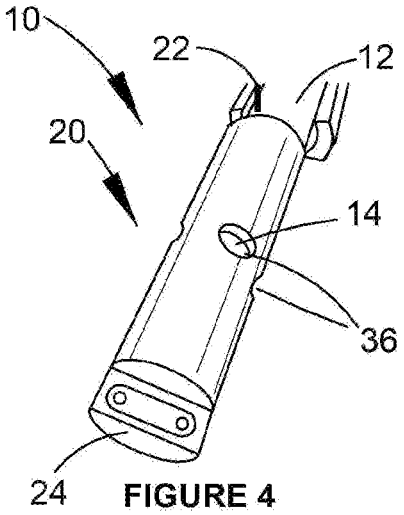
FIG. 4 illustrates the system in use mounted on an end of a core tube.
Figure 5:
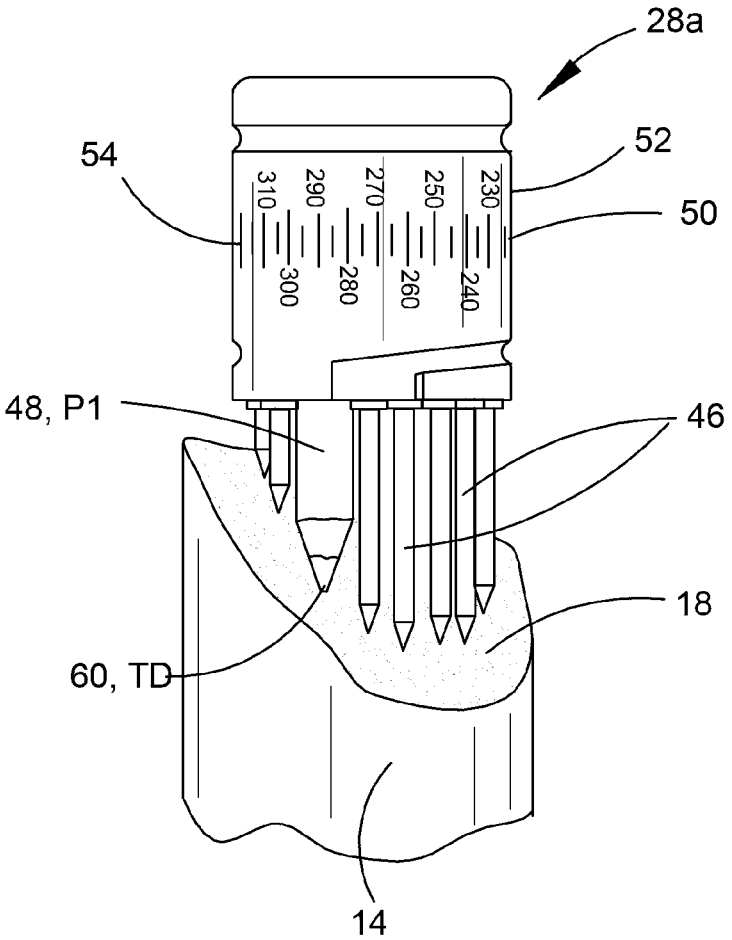
FIG. 5 shows the instrument/record carrier of FIGS. 1-3 when in contact with the core face of a core sample.

This embodiment of the system 10 comprises an instrument guide 20 having a first end 22 and an opposite end 24 that are or can be arranged to lie on a common guide axis 26. The guide axis 26 is parallel to the core axis 16. The instrument guide 20 is configured so that when the first end 22 is coupled or otherwise engaged with the core tube 12, the core face 18 lies between the first and second end 22 and 24. This is shown for example in present FIG. 4.

The system 10 also includes an instrument 28*a* (FIGS. 1-5) that is coupled with the instrument guide 20. The instrument 28*a* is supported or coupled in a manner wherein the instrument guide 20 holds the instrument 28*a* in alignment with the core axis. In some but not all of the embodiments the guide 20 facilitates motion of the instrument 28*a* in a direction parallel to the core axis 16 to a location where the instrument 28*a* contacts the core face 18.

Individual components and parts of the system 10 will now be described in greater detail.

The instrument guide 20 is composed of a first sleeve 30 and a second sleeve 32. The sleeves 30 and 32 are releasably connectable together. In this example this is by way of complementary screw threads 34*a* and 34*b*. The first sleeve 30 is formed with an inner diameter which is slightly larger than the outer diameter of the core tube 12. This enables the instrument guide 20 to engage the core tube 12 with minimal radial play. A number of viewing ports 36 are formed in the sleeve 30 near an end at which the sleeve 30 couples to the sleeve 32. Sleeve 32 houses the instrument 28*a*. The instrument 28*a* is keyed to the sleeve 32 so that it has a known rotational orientation with reference to one or more known reference point P1, P2 . . . Pn (hereinafter referee to in general as known point(s) P), of the system. This is achieved by way of engagement of the instrument 28*a* with mounting pin 38 provided with the sleeve 32. The instrument 28*a* and the mounting pin 38 are arranged so that the instrument 28*a* can lock into the sleeve 32 on the mounting pin 38 in only one specific and known orientation about the guide axis 26.

The system 10 has a rotational position sensor 40, in this example a spirit level 41, to provide an operator with information relating to the rotational position of the known point(s) P of the system 10 about the guide axis 26. The point P maybe one of a plurality of known points P1, P2 etc. Further the one or more points P may be either on or referable to the guide 20 or the instrument 28*a* supported by the guide.

In this instance the rotational position sensor 40 is attached to the instrument guide 20 near the end 24 of the sleeve 32. The system 10 is also provided with an axial passage 42 which is parallel with the axis 26. The passage 42 opens onto the end 24. The passage 42 is provided to enable receipt of a second or alternative instrument 28*b* in the form of a china pencil (see FIG. 6).

The instrument 28*a* has a core face profile recording system 44 which comprises a set of pins 46 and a marker in the form of a pencil 48. The pins 46 are frictionally retained within a body 50 of the instrument 28*a* and are able to slide lineally in a direction parallel to the guide axis 26. An outer surface 52 of the body 50 is provided with a compass or bearing scale 54 (see FIG. 5).

One such point P1 may be the rotational position of the marker 48 of the instrument 28*a* about the guide axis 26. An alternate or additional point P2 may be the rotational position of the axis of the passage 42 about position of the guide axis 26. In this particular embodiment both of these points P1 and P2 lie on the same radius of the guide axis 26. That is, the points P1 and P2 have the same rotational position about the guide axis 26.

The instrument 28*a* also includes a demountable cap 56 (see FIG. 2) that can be mounted on the end of the body 50 from which the pins 46 protrude. The cap 56 when fitted protects the pins 46 from being accidentally displaced in the axial direction.

The cap 56 is also provided with a surface 58 which can be manually marked for example by an indelible marker with header data relating to the core sample. Header data may include: identification data (e.g. a hole number) of the hole from which the core sample 14 is obtained; the driller ID; and the depth of hole at which the sample was extracted. Further details of the instrument 28*a* may be obtained from US publication number 2010/0230165 the contents of which is incorporated herein by way of reference.

A method 100 of using the above described embodiment of the system 10 for enabling at surface core orientation data transfer will now be described.

Figure 7:
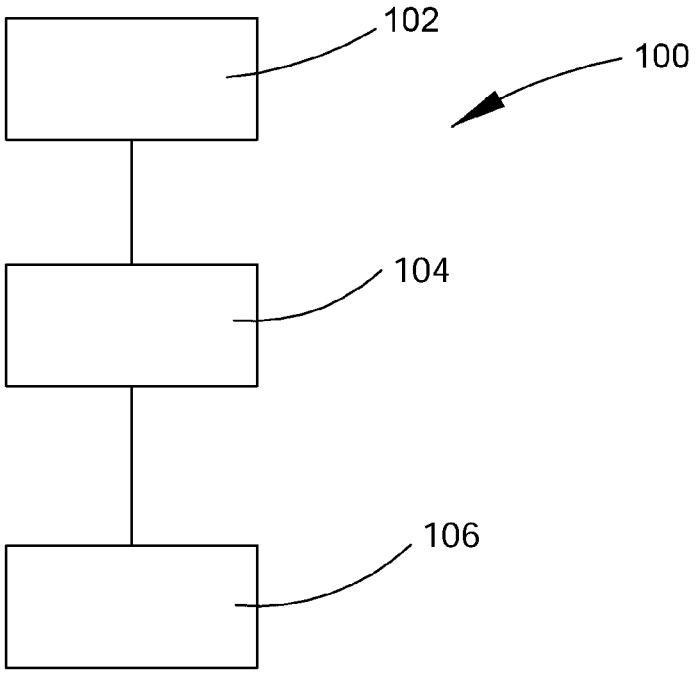
FIG. 7 is a schematic representation of an embodiment of the disclosed method of enabling the transfer of core orientation data.

FIG. 7 shows in a very broad sense an embodiment of the disclosed method 100 for enabling at surface core orientation data transfer from a contactless orientation system 11 coupled with inner core tube 12 to one or more record carriers. In the present embodiment the instrument 28*a* constitutes a record carrier. However the core sample 14 may also constitute a record carrier. (In other embodiments to be described later the record carrier may comprise an electronic memory storage device which is attached to the instrument 28*a*, or may be constituted by electronically storable data such as an electronic image.)

This embodiment of the method 100 can be considered as involving three broad steps namely:

Step 102: coupling the instrument guide 20 to the end of the core tube 12 from which the core face 18 is accessible so that the guide axis 26 is parallel to the core axis 16; Step 104: generating correlation information between a rotational orientation of a known point P on the instrument guide 20 or an instrument 28*a* supported by the instrument guide 20 about the guide axis 26 and core orientation data known to the contactless orientation system; and Step 106: using or otherwise operating the instrument 28*a* to: act as the record carrier; or generate the record carrier provided with the correlation information enabling orientation of the core sample 14 to its in-situ orientation when released from the core tube 12.

As described below the generation of the correlation information between the positions of the known point P and the core orientation data may be via a common reference point A.

With reference to the presently described embodiment of the system 10, the step 102 of coupling the instrument guide 20 to the end of the core tube 12 is achieved by mounting or otherwise arranging the instrument guide 20 relative to the core sample 14 so that the core face 18 lies between the first and second end 22 and 24 of the instrument guide 20. The end 22 of the guide 20 is simply slid onto and over the core sample 14 and the adjacent portion of the inner core tube 12. This arrangement is shown specifically in FIG. 4.

FIGS. 8*a*-8*d* are referred to assist in describing steps 104 and 102 of the present embodiment of the method 100. It is assumed that the contactless orientation system 11 was previously operated to log core orientation data being the in situ rotational position of a specific point on the core about the core axis 16 immediately prior to the core breaking operation relative to a known reference. The known reference may be, but not is limited to, for example:

the gravitational bottom of the hole, this is particularly suitable for inclined holes;

magnetic north; or

True north.

When retrieving the core sample 14 from a drill string and subsequently placing the corresponding core tube 12 on a core table or jig the relative rotational position of the contactless core orientation system 11 and the core sample 14 have not changed. Also the contactless core orientation system 11 by its very nature is able to detect the known reference when at the surface or in the hole.

In this embodiment we will assume that the contactless orientation system 11 logs orientation data of the a point on the core 14 relative to bottom dead centre of the bore hole rather than magnetic north or true north.

Figure 8A:
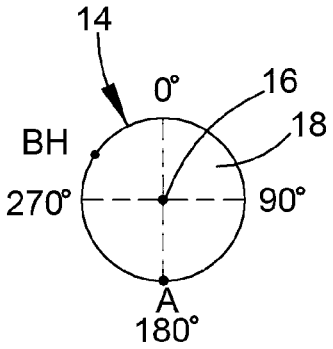
FIGS. 8*a*-8*d* schematically represent a method of referencing the rotational position about the core axis of a known point on the record carrier to a core orientation position measured or otherwise determined by a contactless core orientation system.

FIG. 8*a* shows the gravitational bottom of hole location BH in an angled borehole of the core sample 14 when retrieved from the bore hole and lying horizontally on a core table or jig. In FIG. 8*a* the core face 18 is front on, the core sample 14 is still in the core tube 12 and the system 11 is attached to the back end of the core tube. There has been no relative rotation between the system 11 and the core sample 14. Point BH shows the location of the bottom of the hole of the core 14 as logged by the system 11 immediately prior to the core breaking operation. Point A is a common reference point and in this example corresponds with the location of the bottom of the core sample 14 when at the surface on a core tray. Neither point A nor point BH is physically marked on the core sample 14.

The guide 20 is not coupled to the core tube 12 at this time. The in situ gravitational bottom of hole location BH of the core sample 14, while known to the contactless core orientation system 11 is at a random rotational position about the axis 16. In the present example the point BH is at a bearing of about 300° (or −60° about the axis 16.

Figure 8B:
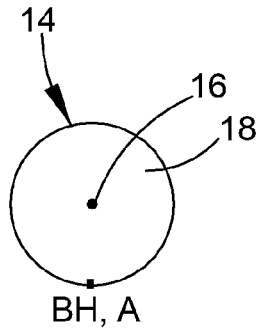

FIG. 8*b* shows a first step in the correlating the position BH with the position of the know point P. This may also be considered as referencing the core orientation data with or to the known location P. This step involves rotating the core tube 12 and thus the core sample 14 until the point BH is at a known location in this instance the common reference point A which is at a bearing of 180°. Because the contactless orientation system 11 knows the location BH, and knows its own location in space, the contactless orientation system 11 can now be operated on the surface to provide feedback to an operator to inform them when the point BH is at the 180° bearing coinciding with point A. This feedback may be by way of audible and/or visual signals emitted by the contactless orientation system 11 or by a handheld or otherwise portable instrument 11 which communicates with the contactless orientation system.

Figure 8C:
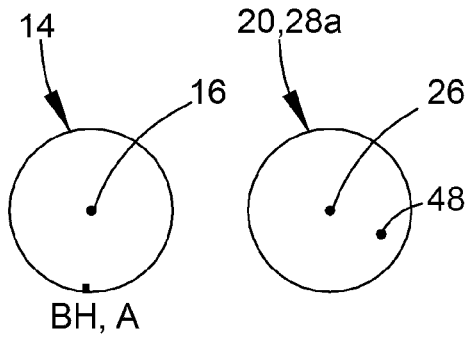

FIG. 8*c* represents the rotational position of the guide 20 on initial mounting on the core tube 12. Now the respective axes 16 and 26 are collinear. Indeed the axes 16 and 26 will be substantially coaxial. The marker 48 which represents a known point P1 on the instrument 28*a* is initially randomly located about axis 26 when the guide 20 is mounted on the core tube 12. In this example point P1/marker 48 is shown at a bearing of about 110° about the guide axis 26.

Figure 8D:
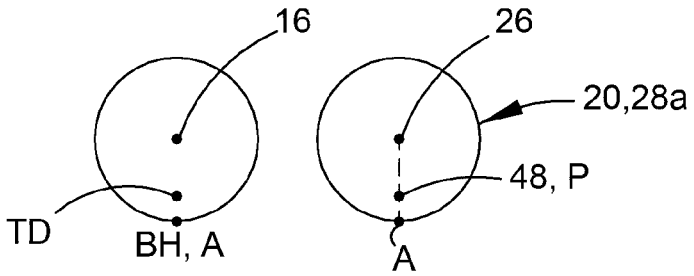

An operator will now rotate the instrument 20 relative to the core tube 16 to level the position of the bubble in a spirit level employed as the rotational position sensor 40. During this process the core sample 14 and core 12 remain rotationally stationary. This will result in the marker 48 being rotated to coincide with the common reference point A at the 180° bearing location. This is also the current physical rotational location position of the point BH. The relative positions of the core sample 12 and the instrument guide 20/instrument 28*a* upon completion of this process is shown in FIG. 8*d*.

Therefore by the above process the location of point P/marker 48 has been correlated with or referenced to the in situ rotational position BH of the core sample. This process has generated correlation data being that the known point P now has the same rotational position about the axes 16, 26 as the point BH. (In another example shown later the correlation data is that the known point P is at a known rotational offset from the point BH.)

The instrument 28*a* is now operated (in this case by using the guide 20 to slide the instrument 28*a* into contact with the face 18), to generate the record carrier provided with the correlation information. Indeed in this example two record carriers are generated. One record carrier 20 is the core 14 while a second independent record carrier is the instrument 28*a*.

Specifically operating instrument 28*a* in this example involves an operator using the guide 20 to move the instrument 28*a* into contact with the face 18. This will result in a linear translation of the pins 46 in accordance with the profile of the face 18 as well as the marker 48 placing a physical mark designating a point TD on the core face 14. This is exemplified in FIGS. 4*d* and 5.

The core face 18 bearing the mark designating the point TD now constitutes a first record carrier of the in situ orientation data of the core sample 14. The mark designating the point TD is or otherwise constitutes the transferred orientation data from the contactless orientation system 11 to the record carrier. Thus the point TD is indicative of the orientation of the known point P and corresponds to or has a known relationship with the in situ orientation of the core sample 14. In this specific embodiment the rotational position of the mark designating the point TD is the same as the orientation of the known point P. However in other embodiments transferred orientation data representing the point TD is not a physical mark on the core sample 14 but rather electronically storable data which provides an indication of the in situ orientation of the core sample 14.

The instrument 28*a*, by virtue of the pins 46 and either the pencil 48 or the hole in which the pencil 48 is held, forms or acts as another independent record carrier bearing correlation information enabling orientation of the core sample 14 to its in situ orientation when released from the core tube 12. By keeping the instrument 28*a* with the core sample 14 a geologist can always properly orientate the core sample 14 by matching the profile of the face 18 with the profile of the pins 46 and then rotating/rolling the instrument 28*a* with the core sample 14 in a horizontal plane so that the location pencil 48 is a bearing of 180°, When at the 180° bearing the geologist knows that the lowermost point of the core 14 corresponds with the point BH recorded by the system 11. Therefore even if the mark representing the point TD on the core face 18 has been lost the core sample 14 can still be placed in its in situ orientation.

The instrument 28*a* can be removed from the guide 20 by decoupling the sleeves 30 and 32 from each other and pulling the instrument 28*a* off of its mounting key 38. The cap 56 may then be attached to the body 50 to protect the pins 46 form accidental displacement. Header data can be manually written onto the surface 58 of the cap 56. The instrument 28*a* is retained with the core sample 12. Thus a new instrument 28*a* is required for each orientation data transfer.

The above position procedure for generating the correlation information or otherwise referencing the in situ core orientation for known point P of the system 10 could also be used for vertical boreholes that do not have a gravitational bottom of hole reference position. This requires the use of a contactless orientation system that relies on magnetic north or true north as the known (detectable) reference point.

Lower Cost Embodiment

Figure 6:
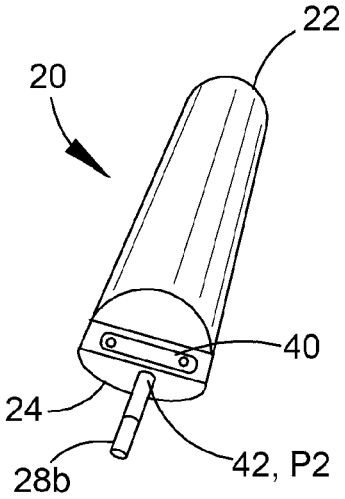
FIG. 6 is a representation of a second embodiment of the system 10 in which the instrument/record carrier shown in FIGS. 1-3 and 5 is replaced with a simpler instrument in the form of a pencil which is able to mark a core face so that the core face itself becomes a record carrier.

In this variation, depicted in FIG. 6, the system 10 uses the instrument 28*b* rather than the instrument 28*a*. The instrument 28*a* is a consumable single use item whereas the instrument 28*b* is used to correlate the known point P with the in situ core orientation to effect transfer of the orientation data onto the core face 18 of many core samples 14. Specifically the instrument 28*b* solely comprises a longer version of the pencil 48 of the instrument 28*a*. The rotationally referencing method is identical to that described above.

In brief the core sample 12 is rotated until the system 11 indicates that the bottom of hole location BH is at the 180° bearing location the guide 20 is fitted onto the core tube 12 and rotated relative to the core tube 12 about the axis 26 until the axis of the passage 42 is also at the 180° bearing location as indicated by the spirit level employed as rotational position sensor 40.

The instrument/pencil 28*b* is inserted into the passage 42 and pushed into contact with the core face 18 leaving a gravitational bottom of hole, true or magnetic north core orientation mark P on the core face 18 in a manner identical to that described above in relation to the instrument/pencil 28*b*. Therefore instead of the guide 20 being physically moved in order to achieve contact, the instrument 28*b* is moved being guided by the passage 42 of the guide 20. The only record carrier in this instance is the core face 18/core 14 itself. There is no separate record carrier as described in the first embodiment.

Electronic Memory Embodiment

In a further variation, the instrument 28*a* may be provided with an electronic memory device 74 (shown schematically in FIG. 9) enabling the electric recording of one or both of header data and audit data. The electronic memory device can be in the form of for example of an RFID chip. This may be embedded in the body 50 of the instrument 28*a*. Header and/or audit data can be transferred automatically from the contactless orientation system 11 to the electronic memory device. The audit data may include for example but is not limited to:

The time and date of moving the instrument 28*a* in a direction parallel to the core axis 16 to contact the core face 18.

The geographical location at which the present method is performed. This may be the way of use of GPS data sourced from the contactless orientation system or indeed from a GPS system also embedded within the guide 20 or the instrument 28*a*.

A degree and direction of rotation of the instrument guide 20 relative to the core tube 12 about the core axis 16 and/or the actual true core orientation position in the time period when the guide system 10 is being used to move the instrument 28*a* relative to the core face 14 to cause contact between the core face and the instrument.

Tool face of the core sample 14.

In order to enable recording of data (c) above, embodiments of the system 10 may also be provided with one or more accelerometers to detect rotational motion about the axis 26. Ideally such GPS and other digital, magnetic or gyroscopic devices will be placed in the guide 20 rather than the instrument 28*a* to reduce the overall cost of the consumable product namely, the instrument 28*a*.

The instrument 28*a* in this embodiment is used in exactly the same manner as described above in relation to the first embodiment of the additional step of electronically transferring information from one, or any combination, of: the system 11; the GPS and other digital, magnetic or gyroscopic device in the guide 20; or other instrument such as smart phone. For example the smart phone may be used to enter some or all of the audit data into the electronic memory.

Figure 9:
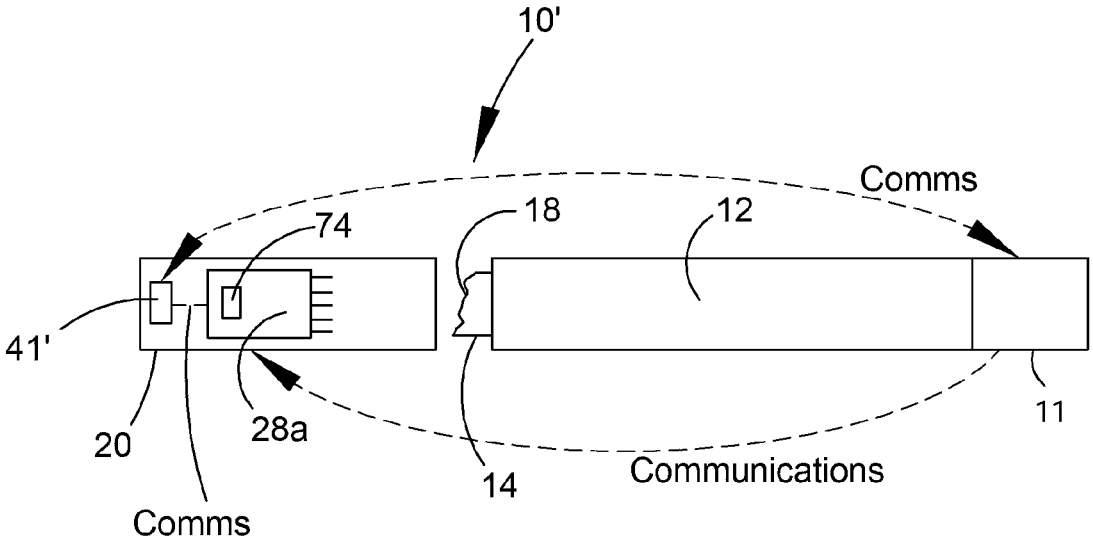
FIG. 9 is a schematic representation of a further embodiment of the disclosed system.

Electronic Generation of Correlation Information (or Rotational Position Referencing) Embodiment FIG. 9 also provides a schematic representation of an embodiment of the system 10' which enables electronic generation of correlation information enabling the rotational referencing of point P relative to point BH. In this embodiment the rotational position sensor 40 is in the form of an electronic rotational orientation system 41' rather than the spirit level described in relation to the first embodiment. The contactless core orientation system 11 is connected to the back end of the core tube 12. In this variation by virtue of the system 41' the system 10'/guide 20 will know or be able to determine by itself the rotational position of point P about the guide axis 26. Thus the bearing of the point BH about axis 16 is known to, or measurable by, the contactless core orientation system 11 and the bearing of the point the point P is known to, or measurable by, the system 41'. Therefore by communication between the contactless orientation system 11 and the rotational position sensor 40 and the use of a basic processor the location of point BH relative to point P can be determined i.e. correlation information can be generated enabling the orientation of the core sample 14 to its in situ orientation when released from the core tube 12. This may be stored on an electronic memory (such a RFID chip described above) on or in the instrument 28*a*.

Figure 10:
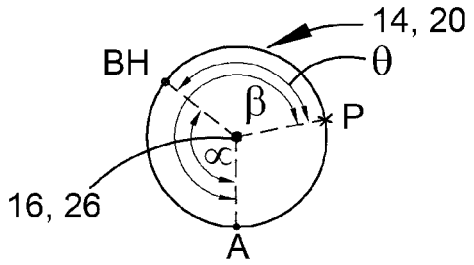
FIG. 10 schematically represents a further embodiment of the disclosed method in which a record of the orientation of the core sample is recorded without any physical contact between an instrument creating the record and the core sample.

The method 100 of referencing the position of point BH to the point P and the subsequent creation of the record carrier bearing the point P is described in more detail below with reference to FIG. 10.

The method 100 entails, once the core sample 14 and core tube 12 are placed on a core table or rack, with point A representing the lowest rotational position of the core sample 14 on the table, i.e. the 180° bearing position:

operating the system 11 to log the position A and therefore determine the rotational offset (e.g. $\alpha°=125°$) of the point BH to the point A (it should be understood that point A is not marked on the core sample 14);

operate the system 41' to determine the rotational position of point P relative to the point A, (e.g. $\beta=260°$, the rotational position of point P being coincident with a known point on the guide 20 such as the axis of passage 42, or the rotational orientation of the instrument 28*a* held within the guide 20, at this time the point TD has not been marked on the core sample 14);

transfer the offset $\alpha°$ to the system 41', or transfer the offset $\beta°$ to the system 11; using a processor in either the system 11, or in the system 41', to calculate the rotational offset (74 $°=\beta°-\alpha°=135°$) between the points BH and P;

transfer the offset $\theta$ to the electronic memory.

The guide 20 can now be used to cause contact between the instrument 28*a* and the core face 14 thereby physically marking the core face 14 with the point TD. Alternately one can first affect the contact between the core face 18 and the instrument 28*a* to mark the core face 18 with the mark representing the point TD and at that time, before separation, electronically reference the location of point P to the point BH. This then removes the possibility of an error being generated by unintended rotation of the guide 20 when performing the contact. It should be noted that in this embodiment there is no need to rotate the guide 20 in order that the point P rotationally coincides with the point A. This is because the offset $\theta$ is now known and recorded. Thus a geologist by accessing a database associated with the core sample 14 knows of the physical point P is offset by $\theta$ degrees from the reference point (in this case gravitational bottom of the hole). The geologist now rotates the core sample 14 about a horizontal axis so that the point P is in the rotational offset position, at which time the core sample 14 will be in its in situ orientation at the time of the core breaking operation.

This embodiment of system 10' requires that the contactless orientation system 11 and the system 41' are able to communicate to each other the bearing of their respective points BH and P. Either one of the systems 11 or 41' can then determine the position of point P relative to the gravitational bottom of hole, magnetic or true north directional location BH. This is communicated to an electronic memory 74 in or on the instrument 28*a* either by the system 11 or the system 41'.

Providing WiFi capability in either the system 11, system 41' or indeed the memory 74 also enables header and/or audit data inclusive of course of core orientation data to be automatically uploaded to a centralised data management system or hub. This then enables a geologist to simply access the database and view the information stored in relation to any particular core sample to enable access to auditable data pertaining to the orientation of the core sample.

Contactless Orientation Data Transfer Embodiment

In an extension or refinement of the system 10' shown in FIG. 9, it is further possible to do away completely with the need for any instrument to physically contact the core sample 14/core face 18. Rather, the instrument generating the record carrier can be an image capture device locatable within or supported by the guide 20 to obtain an image of a core face 18. When the guide 20 is arranged on the core tube 12 with the core face 16 intermediate the ends 20 and 24 an image plane of the image capture device will be square on (i.e. perpendicular to) the core axis 16. Now the image capture device can be used to capture an image of the core face 18. The image may be a photographic image, a stereoscopic image, or indeed an acoustic, radar, gamma, XRAY Fluorescent (XRF) or other type image, or a combination of two or more of such images.

The image capture device is arranged so that the point P can be designated at a specific pixel on an image of the core face 18. This pixel appears in a known manner for, example a cross, on the image. The image capture device (i.e. the instrument) may itself have an inbuilt orientation system which knows and stores information relating to the orientation of the point P about a known reference such as the 180° bearing about a horizontal axis, true North or magnetic north. Alternately the instrument guide 20 supporting instrument 28*a* may have an electronic rotational orientation system 41' as described above which can communicate orientation information to the image capture device.

Since the instrument 11 knows the in situ orientation data the correlation information relating the rotational position of this point P with or to point BH can be generated as described above in relation to the embodiment in FIG. 9. Further, all of the header and other audit data can also be uploaded to the database or hub. Now when a geologist wishes to analyse this data, they will access, either online or by a separate electronic data carrier, an image of the core face with the marked point P together with the header and audit data. The geologist can then compare the image with the core sample at hand and rotate the core sample to its rotational position about its axis 16 at the time of core break. Thus in this embodiment the record carrier is electronic image data enabling display of an image of the core face together with the location of the point P and the correlation information relating the location of point P to the in situ core orientation. Thus a geologist can access a database pertaining to the core sample in question, access and display the image of the core sample locate including the point P on the image, view the core face 18 to locate the corresponding point on the core face then using the stored correlation information determine the in-situ orientation of the core sample 14. For example the correlation information may be that the point P on the display is bottom dead centre.

Whilst a number of specific method and system embodiments have been described, it should be appreciated that the method and system may be embodied in many other forms.

Figure 3:
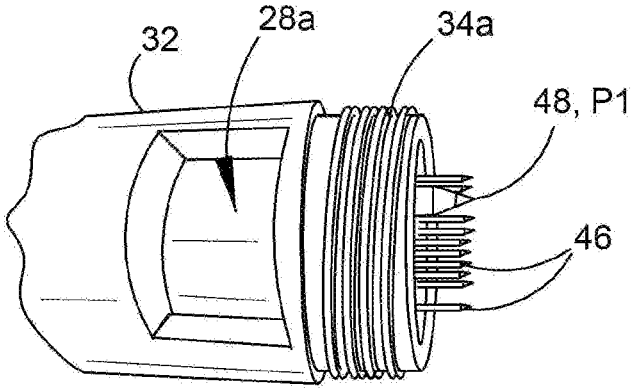
FIG. 3 is a representation of the instrument/record carrier shown in FIG. 2 mounted within the instrument guide.

For example, the record carrier incorporated in the system 10 shown in FIGS. 1-3 comprises a plurality of pins 46 which provide profile points of the core face 18. However the profile may be recorded by use of a plasticised material which takes an imprint of the core face 18 on contact. Also while the instrument guide 20 is depicted as being in the form of a tube provided with a number of circular viewing ports, different configurations are possible. For example, the instrument guide could be provided with a plurality of elongated slots that extend axially between the ends 22 and 24. Further, the instrument guide 20 may be of a different shape such as triangular or be provided with flat bottom surface that provides a horizontal positional reference rather than use of a spirit level. Additionally when the instrument 28*a* is used, the system 10 may be provided with a carriage on which the instrument 28*a* is supported and a lever or other actuator that can be manipulated by an operator to move the carriage linearly along or within the guide 20 to contact the core face 18. Also a core release system such as described in Applicant's co-pending Australian application no. 2015904439 (the contents of which is incorporated herein by way of reference) may be incorporated into the system 10 to assist in releasing the core sample 14 after the transfer of the orientation data. While the contactless core orientation system has been described as providing at least core orientation data (i.e. azimuth or bearing) it may also provide other information such as hole inclination which can be transferred particularly for embodiments of the disclosed system and method that incorporate electronic data storage.

In yet a further variation a camera may be provided in the instrument 28*a* described with reference to FIGS. 1-5 at a location to facilitate image capture of the core face 18. The camera can be operated either (a) prior to contact with the core face; (b) both before and at contact with the face; or (c) continuously from before, to the time of contact with the core face. Operating the camera as per (b) or (c) provides an alternative or additional method of detecting rotation of the instrument 28*a* while being moved into contact with the core face, thus enhancing accuracy and auditability of the core orientation transfer. In a further variation the camera may be demountably connected to the instrument 28*a* to enable it to be reused for every orientation transfer operation rather than once off with a permanently associated instrument 28*a*. An alternate arrangement to enable reuse of the camera is to mount the camera in the guide 20, and configure the instrument 28*a* so that the camera is able to view the core face 18 while the instrument is attached to the guide 20. For example the camera may be in the mounting pin 38 (see FIG. 1) and the instrument 28*a* provided with a coaxial window through which the camera views the core face 18. Data captured by the camera may be used in the same way as described above under the heading "Contactless Orientation Data Transfer Embodiment".

In the claims which follow, and in the preceding description, except where the context requires otherwise due to express language or necessary implication, the word "comprise" and variations such as "comprises" or "comprising" are used in an inclusive sense, i.e. to specify the presence of the stated features but not to preclude the presence or addition of further features in various embodiments of the system and method as disclosed herein.

The invention claimed is:

1. A method of enabling at surface orientation data transfer, the method comprising:

coupling a contactless orientation system with an inner core tube to one or more record carriers on or associated with a core sample held in the core tube, the core sample having a longitudinal core axis and a core face accessible from an end of the inner core tube distal from the contactless orientation system;

arranging an instrument guide which has opposite first and second ends relative to the core sample so that the core face lies between the first and second ends of the instrument guide, and a guide axis, that runs through the first and second ends, lies parallel to the core axis; and using the instrument guide to move an instrument in a direction parallel to the core axis to contact the core face wherein on contact with the core face the instrument constitutes, or is capable of producing, a record carrier of the orientation of the core sample.

2. The method according to claim 1, further comprising prior to moving, generating correlation information between a known point on the instrument guide, or an instrument supported by the instrument guide, about the guide axis and core orientation data known to the contactless core orientation system.

3. The method according to claim 2, further comprising operating the instrument supported in or by the instrument guide to: act as the record carrier; or generate the record carrier provided with, or otherwise having transferred to it, the correlation information enabling orientation of the core sample to its in-situ orientation when released from the core tube.

4. The method according to claim 1, wherein using the instrument guide comprises engaging the instrument with the instrument guide and moving the instrument relative to the core face and parallel to the core axis to cause contact between the core face and the instrument.

5. The method according to claim 4, wherein moving the instrument parallel to the core axis relative to the core face comprises either (a) moving the instrument along, through or within the instrument guide relative to the core face to cause contact between the core face and the instrument; or (b) moving the instrument guide relative to the core face to cause contact between the core face and the instrument.

6. The method according to claim 1, further comprising demountably engaging the instrument with the instrument guide, wherein after contact with the core face the instrument can be removed from the instrument guide.

7. The method according to claim 1, wherein the instrument comprises a plurality of linearly translatable pins which on contact with the core face are capable of recording data pertaining to a profile of the core face.

8. A system for enabling at surface determination of orientation data, the system comprising:

a contactless orientation system coupled with an inner core tube to one or more record carriers associated with a core sample held in the core tube, the core sample having a longitudinal core axis and a core face visible from an end of the inner core tube distal from the contactless orientation system;

an instrument guide having opposite first and second ends that lie on a common guide axis, the instrument guide configured so that when the first end is engaged with the core tube the core face lies between the first and second ends of the instrument guide; and an instrument demountably coupled with the instrument guide in a manner wherein the instrument guide facilitates motion of the instrument in a direction parallel to the core axis to a location where the instrument contacts the core face.

9. The system according to claim 8, wherein the instrument and the instrument guide are provided with respective coupling parts that enable demountable coupling of the instrument to the instrument guide in known rotational juxtaposition about the guide axis.

10. The system according to claim 9, wherein the instrument comprises one or both of: (a) a core face profile recording system; and (b) a scribe or marker capable of placing a mark on the core face.

11. The system according to claim 10, wherein the core face profile recording system comprises a plurality of axially displaceable pins capable of taking an imprint of the core face.

12. The system according to claim 10, wherein the instrument comprises a surface on which header data can be manually transcribed.

13. The system according to claim 8, further comprising a rotation sensing device capable of detecting rotation of the instrument guide about the guide axis.

14. A method of at surface wireless core orientation data transfer, the method comprising:

recording downhole orientation data from a contactless orientation system coupled with an inner core tube with a core sample held in the core tube to an electronically recordable file associated with the core sample, the core sample having a longitudinal core axis and a core face visible from an end of the inner core tube;

when the inner core tube is at the surface, positioning an image plane of an image capture device to lie substantially perpendicular to the core axis and at a location to enable the image capture device to capture an image of the core face;

generating correlation information between a rotational position about the core axis of a known point on the image plane with a rotational point in space about the core axis known to the contactless orientation system and being representative of an in situ rotational orientation of the core sample; and producing an electronically recordable file comprising at least the captured image and the rotational position reference data associated with the core sample.

15. The method according to claim 14, wherein arranging an instrument guide comprises, when the inner core tube is at the surface, coupling the instrument guide to the end of the core tube from which the core face is accessible and opposite the contactless orientation system, and wherein the method further comprises, when the inner core tube is at the surface, generating correlation information between a rotational orientation of a known point on the instrument guide or an instrument supported by the instrument guide about the guide axis with core orientation data known to the contactless orientation system.

16. The method according to claim 15, wherein generating correlation information comprises referencing the rotational position of the known point and an in-situ rotational orientation known to the contactless orientation system to a common reference point.

17. The method according to claim 16, wherein generating correlation information comprises operating the contactless orientation system to facilitate positioning of the core sample about the core axis so that the in situ orientation coincides with the orientation of the common reference point.

18. The method according to claim 16, wherein generating correlation information comprises rotationally aligning the known point with the common reference point.

19. The method according to claim 18, wherein operating the instrument comprises using the instrument guide to move the instrument in a direction parallel to the core axis to contact the core face wherein on contact with the core face the instrument constitutes, or is capable of producing, a record carrier provided with the transferred orientation data.

20. The method according to claim 15, wherein generating correlation information comprises electronically determining the rotational position of the known point.

* * * * *